US006208368B1

(12) United States Patent
Kerr

(10) Patent No.: US 6,208,368 B1
(45) Date of Patent: Mar. 27, 2001

(54) REMOVABLE LEAD SCREW ASSEMBLY FOR AN IMAGE PROCESSING APPARATUS

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/315,366

(22) Filed: May 18, 1999

(51) Int. Cl.[7] ..... B41J 2/47
(52) U.S. Cl. ..... 347/242; 347/245; 346/139 D
(58) Field of Search ..... 347/242, 245, 347/197; 400/120; 346/139 R, 139 D

(56) References Cited

U.S. PATENT DOCUMENTS

| | | | |
|---|---|---|---|
| Re. 28,900 | | 7/1976 | Byers et al. . |
| 3,945,753 | | 3/1976 | Byers et al. . |
| 4,159,813 | | 7/1979 | Yale . |
| 4,628,171 | | 12/1986 | Colby et al. . |
| 5,268,708 | | 12/1993 | Harshbarger et al. . |
| 5,771,059 | | 6/1998 | Kerr et al. . |
| 5,829,889 | * | 11/1998 | Kerr et al. ..... 384/446 |
| 6,033,138 | * | 3/2000 | Kerr ..... 400/328 |

* cited by examiner

*Primary Examiner*—Huan Tran
(74) *Attorney, Agent, or Firm*—David A. Novais; Nelson Adrian Blish

(57) ABSTRACT

An image processing apparatus (10) comprises an imaging drum (300) for holding print media (32) and donor material (36) in registration on the imaging drum (300). A print head (500), driven by a lead screw (250), moves along a line parallel to a longitudinal axis (X) of the imaging drum (300) as the imaging drum (300) rotates. A lead screw assembly (90) is secured in place in a scanning frame by magnetic attraction, with one magnet disposed to constrain axial motion by holding the lead screw to a fixed point and the other magnet disposed to secure the lead screw assembly (90) in place and allow rotational motion. Magnetic attraction allows the removal and replacement of the complete lead screw assembly (90) without tools.

10 Claims, 6 Drawing Sheets

REMOVABLE LEAD SCREW ASSEMBLY FOR AN IMAGE PROCESSING APPARATUS

CROSS REFERENCE TO RELATED APPLICATIONS

The present invention is related to co-pending application Ser. No. 09/080,841 filed on May 18, 1998, entitled MAGNETICALLY HELD MOTOR STOP; co-pending application Ser. No. 09/144,390 filed on Aug. 31, 1998, entitled METHOD OF CONTROLLING A PRINTHEAD MOVEMENT BASED ON A SCREW PITCH TO MINIMIZE SWATH-TO-SWATH ERROR IN AN IMAGE PROCESSING APPARATUS; and co-pending application Ser. No. 08/795,171 filed on Feb. 4, 1997, entitled A METHOD AND APPARATUS FOR MAGNETICALLY PRELOADING A BALL BEARING ASSEMBLY.

FIELD OF THE INVENTION

This invention relates to the mechanical configuration of a lead screw and its stepper motor in an image processing apparatus.

BACKGROUND OF THE INVENTION

Pre-press color proofing is a procedure that is used by the printing industry for creating representative images of printed material, without the high cost and time that is required to actually produce printing plates and set up a high-speed, high-volume, printing press to produce a single example of an intended image. These intended images may require several corrections and may need to be reproduced several times to satisfy the requirements of customers, resulting in a large loss of profits. By utilizing pre-press color proofing, time and money can be saved.

One such commercially available image processing apparatus, which is depicted in U.S. Pat. No. 5,268,708, is an image processing apparatus having half-tone color proofing capabilities. This image processing apparatus is arranged to form an intended image on a sheet of thermal print media by transferring colorant from a sheet of donor material to thermal print media by applying a sufficient amount of thermal energy to the donor material to form an intended image. This image processing apparatus is comprised generally of a material supply assembly or carousel, a lathe bed scanning subsystem (which includes a lathe bed scanning frame, a translation drive, a translation stage member, a print-head, and a vacuum imaging drum), and thermal print media and donor material exit transports.

The operation of the image processing apparatus of U.S. Pat. No. 5,268,708 comprises metering a length of the thermal print media (in roll form) from the material assembly or carousel. The thermal print media is then measured and cut into sheet form of the required length, transported to the vacuum imaging drum, registered, wrapped around and secured onto the vacuum imaging drum. Next a length of donor material (in roll form) is also metered out of the material supply assembly or carousel, measured and cut into sheet form of the required length. It is then transported to and wrapped around the vacuum imaging drum, such that it is superposed in the desired registration with respect to the thermal print media (which has already been secured to the vacuum imaging drum).

After the donor material is secured to the periphery of the vacuum imaging drum, the scanning subsystem or write engine provides the scanning function. This is accomplished by retaining the thermal print media and the donor material on the spinning vacuum imaging drum while it is rotated past the print head that will expose the thermal print media. The translation drive then traverses the print head and translation stage member axially along the vacuum imaging drum, in coordinated motion with the rotating vacuum imaging drum. These movements combine to produce the intended image on the thermal print media.

The lathe bed scanning frame provides the structure to support the vacuum imaging drum and its rotational drive. The translation drive with the translation stage member and print head are supported by two translation bearing rods that are substantially straight along their longitudinal axis and are positioned parallel to the vacuum imaging drum and a lead screw. Consequently, they are parallel to each other therein forming a plane, along with the vacuum imaging drum and lead screw. The translation bearing rods are, in turn, supported by the outside walls of the lathe bed scanning frame of the lathe bed scanning subsystem or write engine. The translation bearing rods are positioned and aligned there between, for permitting low friction movement of the translation stage member and the translation drive. The translation bearing rods are sufficiently rigid for this application, so as not to sag or distort between the mounting points at their ends. They are arranged to be as exactly parallel as is possible with the axis of the vacuum imaging drum. The front translation bearing rod is arranged to locate the axis of the print head precisely on the axis of the vacuum imaging drum with the axis of the print head located perpendicular, vertical, and horizontal to the axis of the vacuum imaging drum. The translation stage member front bearing is arranged to form an inverted "V" and provides only that constraint to the translation stage member. The translation stage member with the print head mounted on the translation stage member, is held in place by its own weight. The rear translation bearing rod locates the translation stage member with respect to rotation of the translation stage member about the axis of the front translation bearing rod.

In U.S. Pat. No. 5,268,708, the translation stage member and print head are attached to a rotatable lead screw (having a threaded shaft) by a drive nut and coupling. The coupling is arranged to accommodate misalignment of the drive nut and lead screw so that only rotational forces and forces parallel to the lead screw are imparted to the translation stage member by the lead screw and drive nut. The lead screw rests between two sides of a lathe bed scanning frame of the lathe bed scanning subsystem or write engine, where it is supported by deep groove radial bearings. At the drive end the lead screw continues through the deep groove radial bearing, through a pair of spring retainers, that are separated and loaded by a compression spring to provide axial loading, and to a DC servo drive motor and encoder. The DC servo drive motor induces rotation to the lead screw moving the translation stage member and print head along the threaded shaft as the lead screw is rotated. The lateral directional movement of the print head is controlled by switching the direction of rotation of the DC servo drive motor and thus the lead screw.

Although the presently known and utilized image processing apparatus is satisfactory, it is not without drawbacks. In order to achieve the positioning accuracy for high-resolution imaging at 1800 dots per inch or greater, the apparatus described above utilizes a lead screw having a very fine thread pitch. Approaches to this problem disclosed in co-pending application Ser. No. 09/144,390 filed on Aug. 31, 1998 allow a coarser lead screw pitch to be used.

It can be appreciated that a significant amount of design work is required to maintain synchronization and dot addressability in an imaging apparatus where a print head, possibly having a variable number of light sources, is moving linearly along a high-speed rotating imaging drum. To achieve the necessary timing for this imaging task, a specific lead screw thread pitch is selected for the imaging resolution that is required. Co-pending application Ser. No. 09/144,390 filed on Aug. 31, 1998 discloses a method and example for calculating lead screw pitch for an apparatus imaging at 2540 dots per inch.

It would be advantageous to be able to readily change the resolution of an imaging apparatus to suit different requirements of end-customers who use such equipment. For example, there are significant advantages for an image processing apparatus that could operate at both 2540 dots per inch and at 2400 dots per inch. A preferred solution for meeting this requirement is to enable each resolution using a different lead screw pitch.

It will be appreciated that changing the lead screw in a high-resolution imaging apparatus presents considerable problems. Conventional solutions would require a significant amount of disassembly to loosen the lead screw from mounting, fastening, and support hardware at each end and to install the alternate lead screw in its place. Service costs for lead screw replacement at an end-customer site would limit the market value of such a solution. End-customers would be likely to reject conventional solutions for lead screw replacement as troublesome, costly, time-consuming, and error-prone.

Lead screw replacement conventionally requires tools and involves well-trained personnel to make necessary adjustments so that synchronization timing can be maintained. Patents that disclose methods for lead screw replacement include U.S. Pat. No. 4,628,171, which discloses a mechanical-feed boring machine tool with interchangeable lead screws, where different lead screw pitches are needed to change the threading pitch achieved by this machine. Conventional hand tools and detailed disassembly procedures are required to substitute another lead screw having a different thread pitch with this approach.

The apparatus disclosed in U.S. Pat. No. 5,771,059 employs a magnet integrally attached to the lead screw that allows one end of the lead screw to be removed from its position in the scanning frame. Also, the apparatus disclosed in co-pending application Ser. No. 08/795,171 uses a magnetically loaded radial bearing integrated with the lead screw shaft that allows the opposite end of the lead screw to be securely held in position within a frame, while at the same time providing a bearing to allow rotational movement. However, none of the arrangements noted above show or suggest a structure or method which permits the removal and the re-seating of a complete lead-screw assembly without requiring tools.

SUMMARY OF THE INVENTION

The present invention provides for an apparatus which overcomes the drawbacks noted above. Briefly summarized, according to one aspect of the present invention, the invention resides in an imaging processing apparatus of the lathe-bed scanning type, where a print head is secured to a translation stage member. A lead screw provides linear movement of the translation stage member. The assembly comprises the lead screw and its attached motor and support hardware which form a removable, modular assembly that is held in place by magnetic attraction, and can be removed from and re-seated in a scanning frame without tools.

An object of the present invention is to provide for a lead screw assembly that installs in the scanning frame as a single unit and is self-seating, fitting into place and secured in the proper position without mechanical fasteners.

It is an advantage of the present invention that it enables an image processing apparatus to be operable with any one of a set of lead screws, where each lead screw can have a different thread pitch or other characteristics.

It is a further advantage of the present invention that it allows installation or removal of a lead screw assembly in an image processing apparatus without tools and without mechanical adjustments for precision alignment.

It is noted that the present invention could be used in other applications, including imaging applications that are not limited to imaging using dye transfer. It is recognized that the present invention is pertinent to various types of laser, heat, or radiation-induced transfer involving colorants such as inks, dyes, or pigments. The present invention could also be employed in other types of devices where it is useful to be able to remove a lead screw and its associated components without tools.

The present invention relates to a writing assembly having a removable self-seating lead screw. The writing assembly comprises a supporting frame; a lead screw which defines a linear direction of movement for a writing element; and an attraction assembly for permitting an insertion of the lead screw to an operating position on the supporting frame. The lead screw is held in the operating position while being permitted to rotate about a longitudinal axis of the lead screw. The attraction assembly permits a manual removal of the lead screw from the operating position on the supporting frame.

The present invention further relates to a writing assembly having a removable lead screw which comprises a frame member for supporting the lead screw; first attraction means attached to a first end of the lead screw; second attraction means on the frame member for attracting the first attraction means to removably hold the first end of the lead screw on the frame member when the lead screw is in an operating position on the frame member; a magnetically loaded radial bearing mounted on a second end of the lead screw which permits a rotation of the lead screw when the lead screw is in the operating position; and a receiving means on the frame member for removably holding the radial bearing therein when the lead screw is in the operating position, the lead screw being manually removable at the first and second ends from the frame member.

The present invention further relates to a lead screw assembly for an image capture device which comprises a lead screw which defines a linear direction of movement for a writing element; a first attraction member on a first end of the lead screw which cooperates with a second attraction member on a frame of the image capture device to rotatably and removably hold the first end of the lead screw on the frame; and a bearing member provided on a second end of the lead screw which cooperates with a receiving member on the frame to rotatably and removably hold the second end of the lead screw on the frame.

The present invention further relates to a method of removably mounting a lead screw assembly of an image capture device. The method comprises the steps of: providing a first attraction member on a first end of a lead screw, with the lead screw defining a linear direction of movement for a writing assembly of the image capture device; providing a bearing member on a second end of the lead screw; and attaching the lead screw to a frame member of the image capture device. The first attraction member cooperates with a second attraction member on the frame and the bearing member cooperates with a receiving member on the frame to removably hold the lead screw to the frame at the first and second ends.

The present invention further relates to an image processing apparatus which comprises a writing assembly mounted on a supporting member so as to be adjacent to an imaging member; a removable lead screw assembly which provides a linear movement to the writing assembly relative to the imaging member, with the lead screw assembly comprising a lead screw and a drive motor which rotates the lead screw; and an attraction assembly which holds the lead screw assembly in an operating position on the support member in a manner which permits a removal of the lead screw assembly as a unit from the operating position on said supporting member.

DETAILED DESCRIPTION OF THE INVENTION

Figure 1:
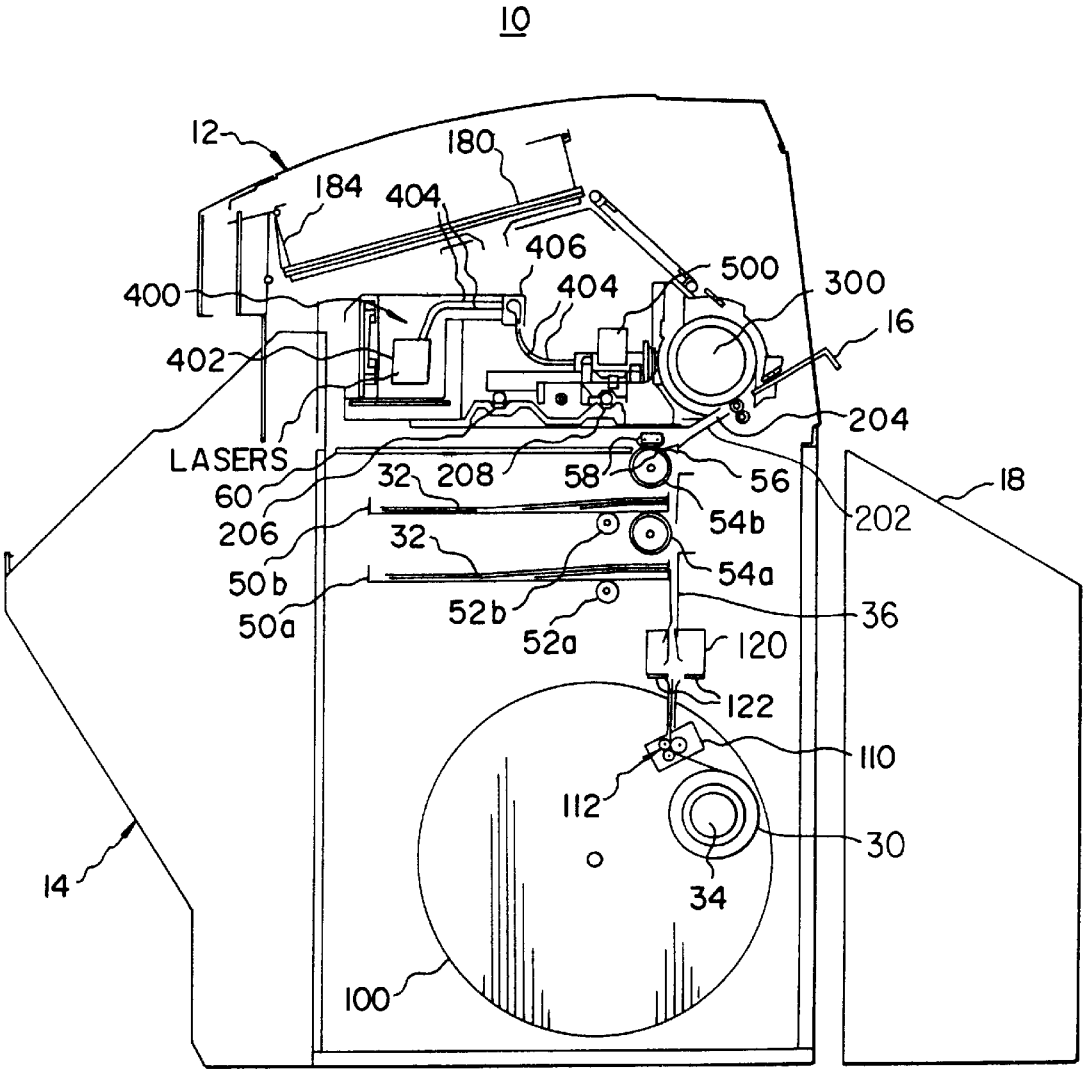
FIG. 1 is a side view in vertical cross section of an image processing apparatus of the present invention.

Referring now to the drawings, wherein the like reference numerals represent identical or corresponding parts throughout the several views, FIG. 1 illustrates an example of an image processing apparatus 10 relevant to the present invention. Image processing apparatus 10 includes an image processor housing 12 which provides a protective cover. A movable, hinged image processor door 14 is attached to a front portion of image processor housing 12 permitting access to sheet material trays, such as lower sheet material tray 50*a* and upper sheet material tray 50*b*, that are positioned in an interior portion of image processor housing 12, for supporting print media 32 thereon. Only one of sheet material trays 50*a*, 50*b* will dispense print media 32 out of its sheet material tray to create an intended image thereon; the alternate sheet material tray 50*a*, 50*b* either holds an alternative type of print media 32 or functions as a back up sheet material tray. In this regard, lower sheet material tray 50*a* includes lower media lift cam 52*a* for lifting lower sheet material tray 50*a* and ultimately print media 32, upwardly toward rotatable, lower media roller 54*a* and toward a second rotatable, upper media roller 54*b* which, when both are rotated, permit print media 32 to be pulled upwardly towards a movable media guide 56. Upper sheet material tray 50*b* includes upper media lift cam 52*b* for lifting upper sheet material tray 50*b* and ultimately print media 32 towards upper media roller 54*b* which directs it towards media guide 56.

Media guide 56 directs print media 32 under a pair of media guide rollers 58 which engage print media 32 for assisting upper media roller 54*b* in directing it onto a media staging tray 60. Media guide 56 is attached and hinged to a lathe bed scanning frame 202 at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving print media 32 resting on media staging tray 60 under the pair of media guide rollers 58, upwardly through an entrance passageway 204 and around a rotatable vacuum imaging drum 300.

A roll 30 of colorant donor roll material 34 is connected to a media carousel 100 in a lower portion of image processor housing 12. Four rolls of roll media 30 are used, but only one is shown for clarity. Each roll media 30 includes a donor roll material 34 of a different color, typically black, yellow, magenta and cyan. These donor roll materials 34 are ultimately cut into donor sheet materials 36 and passed to vacuum imaging drum 300 for forming the medium from which colorant imbedded therein is passed to print media 32 resting thereon. In this regard, a media drive mechanism 110 is attached to each roll 30 of donor roll material 34, and includes three media drive rollers 112 through which the donor roll material 34 of interest is metered upwardly into media knife assembly 120. After the donor roll material 34 reaches a predetermined position, media drive rollers 112 cease driving the donor roll material 34 and two media knife blades 122 positioned at a bottom portion of media knife assembly 120 cut the donor roll material 34 into donor materials 36. Lower media roller 54*a* and upper media roller 54*b* along with media guide 56 then pass a donor sheet material 36 onto media staging tray 60 and ultimately to vacuum imaging drum 300; and in registration with print media 32 using the same process as described above for passing print media 32 onto vacuum imaging drum 300. The donor sheet material 36 now rests atop print media 32 with a narrow space between the two created by microbeads imbedded in the surface of print media 32.

A laser assembly 400 includes a quantity of laser diodes 402 in its interior. Lasers diodes 402 are connected via fiber optic cables 404 to distribution block 406 and ultimately to a print head 500. Print head 500 directs energy received from laser diodes 402 causing the donor sheet material 36 to pass the desired color across the gap to print media 32. Print head 500 is attached to a lead screw 250 (FIG. 2) via a lead screw drive nut 254 and drive coupling (not shown), for permitting movement axially along a longitudinal axis of vacuum imaging drum 300 for transferring the data to create the intended image onto print media 32.

For writing, vacuum imaging drum 300 rotates at a constant velocity, and print head 500 begins at one end of print media 32 and traverses the entire length of the print media 32 for completing the transfer process for the particular donor sheet material 36 resting on print media 32. After print head 500 has completed the transfer process, for the particular donor sheet material 36 resting on print media 32, the donor sheet material 36 is then removed from vacuum imaging drum 300 and transferred out of image processor housing 12 via a skive or ejection chute 16. Donor sheet material 36 eventually comes to rest in a waste bin 18 for removal by the user. The above described process is then repeated for the other three rolls of roll media 30 of donor roll materials 34.

Figure 2:
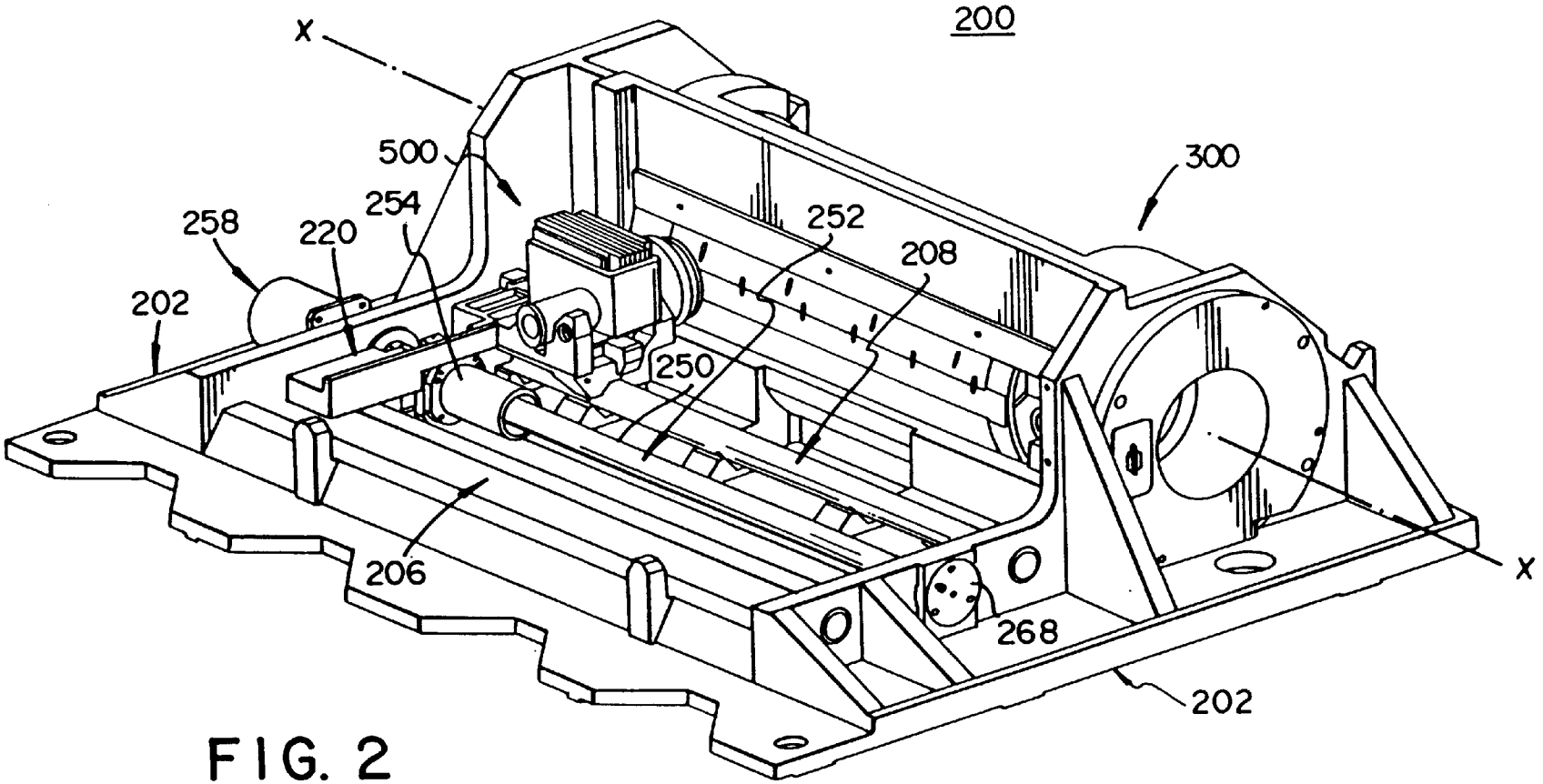
FIG. 2 is a perspective view of a lathe-bed scanning subsystem or write engine of the present invention, as viewed from the rear of the image processing apparatus.

Referring to FIG. 2, there is illustrated a perspective view of a lathe bed scanning subsystem 200 of image processing apparatus 10, including vacuum imaging drum 300, print head 500 and lead screw 250 assembled in lathe bed scanning frame 202. Vacuum imaging drum 300 is mounted for rotation about an axis X in lathe bed scanning frame 202. Print head 500 is movable with respect to vacuum imaging drum 300, and is arranged to direct a beam of light to donor sheet material 36. As an example, the beam of light from print head 500 for each laser diode 402 (not shown in FIG. 2) can be individually modulated by modulated electronic signals from image processing apparatus 10, which are representative of the shape and color of the original image; so that the color on the donor sheet material 36 is heated to cause volatilization only in those areas in which its presence is required on the print media 32 to reconstruct the shape and color of the original image.

Print head 500 is mounted on movable translation stage member 220 which, in turn, is supported for low friction slidable movement on translation bearing rods 206 and 208. Translation bearing rods 206 and 208 are arranged as parallel as possible with axis X of vacuum imaging drum 300. A longitudinal axis of print head 500 is perpendicular to the axis X of vacuum imaging drum 300. Front translation bearing rod 208 locates translation stage member 220 in vertical and horizontal directions with respect to axis X of vacuum imaging drum 300. Rear translation bearing rod 206 locates translation stage member 220 with respect to rotation of translation stage member 220 about front translation bearing rod 208, so that there is no over-constraint condition of translation stage member 220 which might cause it to bind, chatter, or otherwise impart undesirable vibration or jitters to print head 500 during the generation of an intended image.

Figure 3:
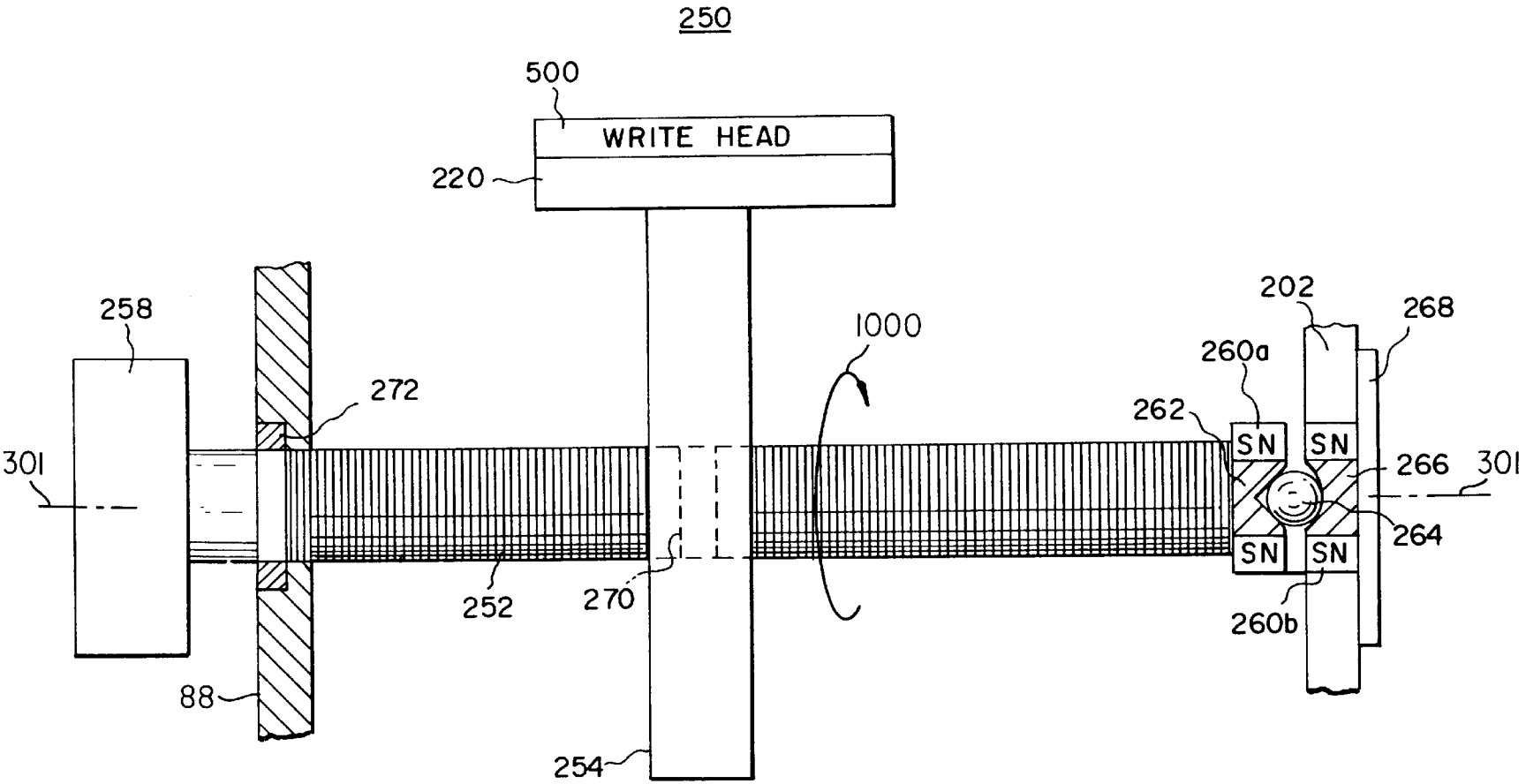
FIG. 3 is a top view in horizontal cross-section, partially in phantom, of the lead screw of the present invention.

As shown in FIG. 3, lead screw 250 is attached to a linear drive motor 258 on its drive end and to lathe bed scanning frame 202 by means of radial bearing 272. Lead screw drive nut 254 includes grooves in its hollowed-out center portion 270 for mating with threads of threaded shaft 252 of lead screw 250, for permitting lead screw drive nut 254 to move axially along threaded shaft 252 as threaded shaft 252 is rotated by linear drive motor 258. Lead screw drive nut 254 is integrally attached to print head 500 through a lead screw coupling and translation stage member 220 at its periphery so that as threaded shaft 252 is rotated by linear drive motor 258, lead screw drive nut 254 moves axially along threaded shaft 252, which in turn moves translation stage member 220 and ultimately print head 500 axially along vacuum imaging drum 300.

As best illustrated in FIG. 3, and as described in U.S. Pat. No. 5,771,059, an annular-shaped axial load magnet 260*a* is integrally attached to a driven end of threaded shaft 252, and is in a spaced apart relationship with another annular-shaped axial load magnet 260*b* attached to lathe bed scanning frame 202. Axial load magnets 260*a* and 260*b* are preferably made of rare-earth materials such as neodymium-iron-boron. A generally circular-shaped boss part 262 of threaded shaft 252 rests in a hollowed-out portion of annular-shaped axial load magnet 260*a*, and includes a generally V-shaped surface at the end for receiving a ball bearing 264. A circular-shaped insert 266 is placed in a hollowed-out portion of the other annular-shaped axial load magnet 260*b*, and includes a shaped surface on one end for receiving ball bearing 264, and a flat surface at its other end for receiving end cap 268. End cap 268 is placed over annular-shaped axial load magnet 260*b* and attached to lathe bed scanning frame 202 for protectively covering annular-shaped axial load magnet 260*b* and providing an axial stop for lead screw 250. Circular shaped insert 266 is preferably made of material such as Rulon J or Delrin AF, both well known in the art.

Lead screw 250 operates as follows. Linear drive motor 258 is energized and imparts rotation to lead screw 250 about axis 301, as indicated by the arrow 1000, causing lead screw drive nut 254 to move axially along threaded shaft 252. Annular-shaped axial load magnets 260*a* and 260*b* are magnetically attracted to each other which prevents axial movement of lead screw 250. Ball bearing 264, however, permits rotation of lead screw 250 while maintaining the positional relationship of annular-shaped axial load magnets 260*a*, 260*b*, i.e., slightly spaced apart, which prevents mechanical friction between them while obviously permitting threaded shaft 252 to rotate.

Print head 500 travels in a path along vacuum imaging drum 300, while being moved at a speed synchronous with the rotation of vacuum imaging drum 300 and proportional to a width of a writing swath. The pattern that print head 500 transfers to print media 32 along vacuum imaging drum 300 is a helix.

Figure 4:
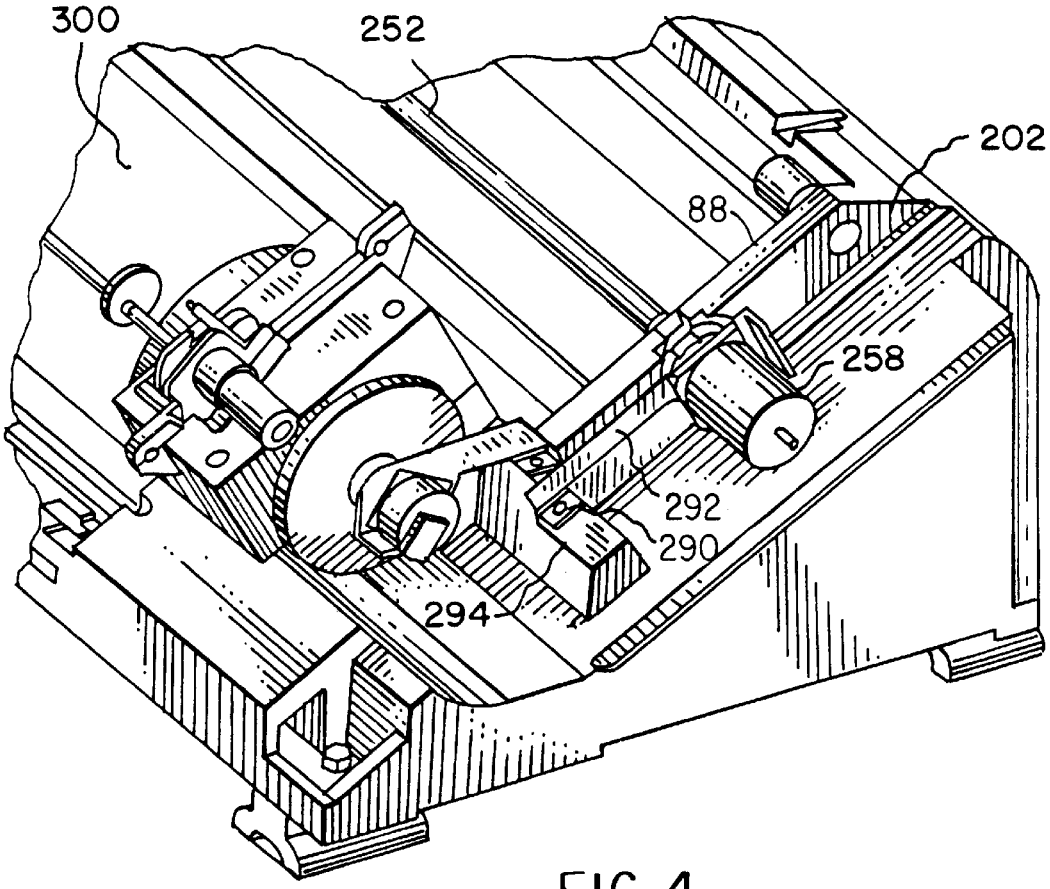
FIG. 4 is a perspective view showing components on a motordriven side of the lead screw in a preferred embodiment of the present invention.
Figure 5:
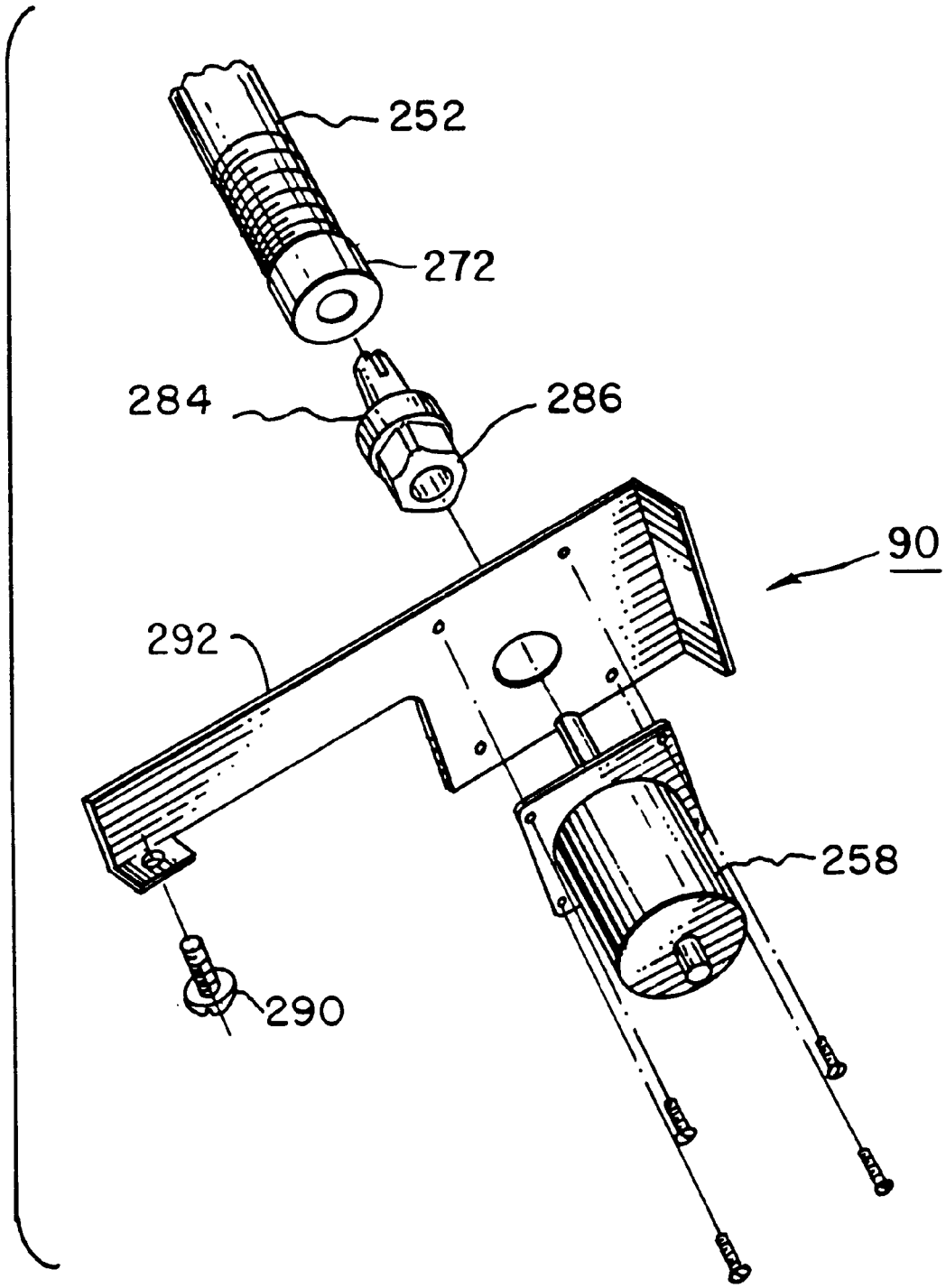
FIG. 5 shows an exploded view of the assembly of components on the motor-driven side of the lead screw in the embodiment shown in FIG. 4.

FIGS. 4 and 5 show components at the drive end of lead screw 250. Radial bearing 272 which is a magnetically loaded radial bearing is mounted on threaded shaft 252 (FIG. 5). Linear drive motor 258 is a stepper motor in the preferred embodiment of this invention. As shown in FIG. 5, a shaft 258*a* of linear drive motor 258 attaches to threaded shaft 252 of lead screw 250 by means of a collet 284, secured by a nut collet 286. Motor 258 mounts to a rotational motor stop or frame 292, which provides a rotational stop that constrains movement of motor 258 as its shaft rotates. A stop button 290 attached to rotational motor stop 292 is magnetically attracted to a stop magnet 294 which is installed inside lathe bed scanning frame 202 (at the position shown in FIG. 4).

The components illustrated in FIG.5 make up a lead screw assembly 90. Lead screw assembly 90 is removable as a unit from its position in lathe bed scanning frame 202.

Figure 6:
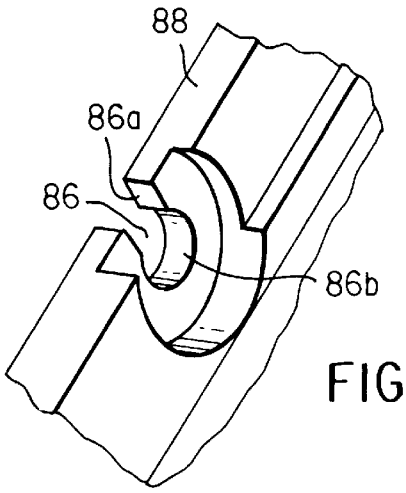
FIG. 6 shows an opening provided in a side panel of a scanning frame for placement of the lead screw assembly.

FIG. 6 shows an aperture 86 in a motor support member 88 of lathe bed scanning frame 202, with lead screw assembly 90 removed. In an operating position, the motor end (with motor 258) of lead screw assembly 90 is held in place in motor support member 88 by magnetization of radial bearing 272. The opposite end of lead screw assembly 90 is held in place by attraction of axial load magnets 260*a* and 260*b* as shown in FIG. 3. With this arrangement, magnetic attraction at both ends fixes the axis of threaded shaft 252 into position with respect to lathe bed scanning frame 202. Then, to prevent rotation of lead screw assembly 90 as threaded shaft 252 rotates, rotational motor stop 292 is provided, and held in position by magnetic attraction at stop button 290.

An access slot 86*a* of aperture 86 is sized to be slightly larger than a diameter of threaded shaft 252, to permit the removal of lead screw assembly 90 only after the opposite end of lead screw assembly 90 is pulled away a slight distance from axial load magnets 260*a* and 260*b*, so that radial bearing 272 and other components on the motor end of lead screw assembly 90 can clear the access slot. A circular inner portion 86*b* of aperture 86 is sized so that radial bearing 272 fits snugly into motor support member 88, held by magnetic attraction of radial bearing 272 to motor support member 88. Attraction of axial load magnets 260*a* and 260*b* at the opposite end of threaded shaft 252 hold lead screw assembly 90 at the correct position so that lead screw assembly 90 can be removed and re-seated in the same position each time.

Figure 7A:
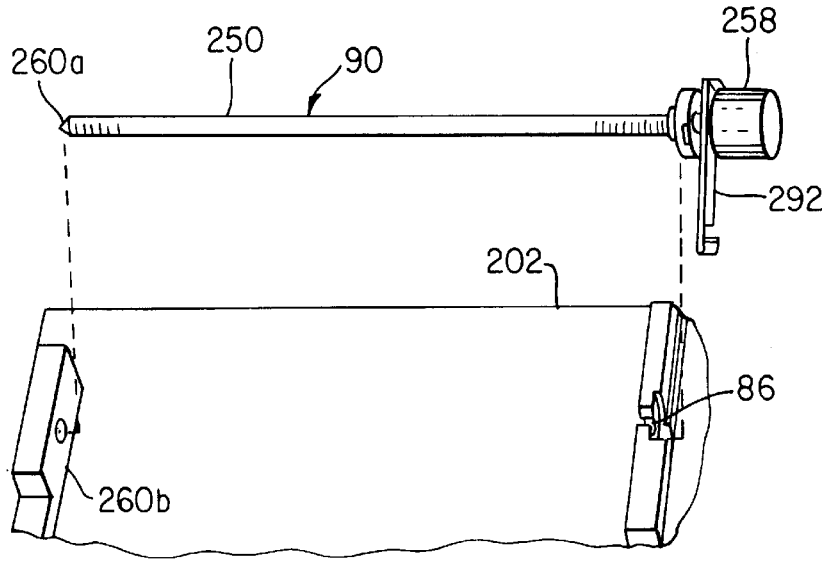
FIGS. 7*a* and 7*b* illustrate an exploded view showing the lead screw assembly as it is installed or removed, relative to the print head and to the main chassis of the lathe-bed scanning subsystem.
Figure 7B:
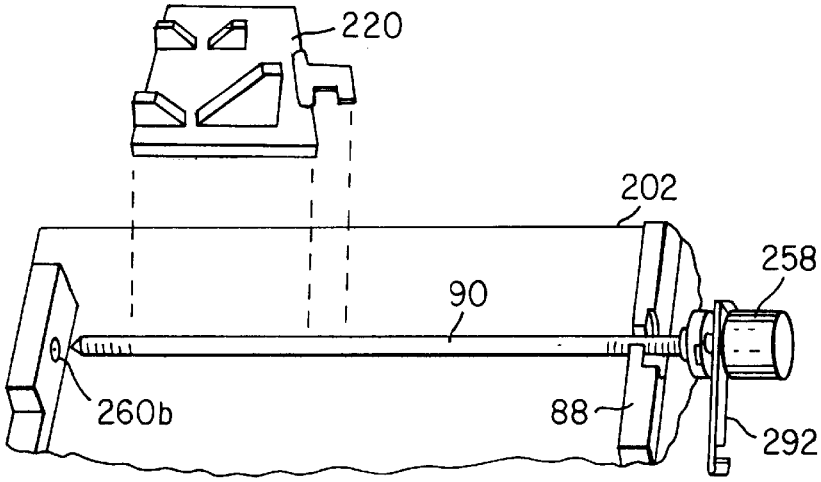

FIGS. 7*a* and 7*b* show how lead screw 250 or lead screw assembly 90 including lead screw 250 are removed from lathe bed scanning frame 202. First, translation stage member 220 and print head 500 (not shown in FIGS. 7*a* and 7*b*) must be disconnected from lead screw 250. In the preferred embodiment of this invention, two screws (not shown) must be removed to unfasten translation stage member 220 from lead screw 250. In the preferred embodiment of this invention, a modular electrical connector (not shown) must also be disconnected from linear drive motor 258.

To free lead screw 250 or lead screw assembly 90 including lead screw 250 from its magnetic attraction points, rotational motor stop 292 is first pivoted up from attraction at stop magnet 294. Next, lead screw 250 or lead screw assembly 90 including lead screw 250 are pulled away from axial load magnet 260*b*. Lead screw 250 or lead screw assembly 90 including lead screw 250 can then be pulled out horizontally from its normal operating position (to the right, as viewed in FIG. 7*a*), so that the diameter of threaded shaft 252 clears access slot 86*a* in aperture 86, allowing removal of lead screw assembly 90.

Insertion of an alternate lead screw 250 or lead screw assembly 90 including lead screw 250 is the reversal of the above procedure. Once lead screw 250 is fed through access slot 86*a* in aperture 86, axial load magnets 260*a* and 260*b* attract the end of lead screw assembly 90 against lathe bed scanning frame 202. Then, rotational motor stop 292 is pivoted into place, and held securely at stop magnet 294. Finally, any needed electrical connections can be made to linear drive motor 258 and translation stage member 220 can be reinstalled.

The invention has been described with reference to the preferred embodiment thereof. However, it will be appreciated and understood that variations and modifications can be effected within the spirit and scope of the invention as described herein above and as defined in the appended claims, by a person of ordinary skill in the art without departing from the scope of the invention. For example, the overall configuration and arrangement of the slot and circular inner portion for the aperture can be altered without changing the scope of the invention.

What is claimed is:

1. A scanning assembly having a removable lead screw, the scanning assembly comprising:

attraction means on said frame member fir attracting said first attraction means to removably hold said first end of said lead screw on said frame member when said lead screw is in an operating position on said frame member;

a magnetically loaded radial bearing mounted on a second end of said lead screw which permits a rotation of said lead screw when said lead screw is in said operating position;

a receiving means on said frame member for removably holding said radial bearing therein when said lead screw is in said operating position, said lead screw being manually removable at said first and second ends from said frame member;

a drive motor operationally associated with said second end of said lead screw for rotating said lead screw; and a rotational stop mounted to said second end of said lead screw to prevent rotation of at least said drive motor as said lead screw rotates.

2. A scanner assembly according to claim 1, wherein one of said first and second attraction means is a magnet and the other of said first and second attraction means is a ferromagnetic member.

3. A removable lead screw assembly for an image capture device, the lead screw assembly comprising:

a lead screw which defines a linear direction of movement for a writing element;

a first attraction member on a first end of said lead screw which cooperates with a second attraction member on a frame of said image capture device to rotatably and removably hold said first end of said lead screw on said frame;

a bearing member provided on a second end of said lead screw which cooperates with a receiving member on said frame to rotatably and removably hold said second end of said lead screw on said frame;

a drive motor operationally associated with said second end of said lead screw for rotating said lead screw about a longitudinal axis of said lead screw; and a rotational stop mounted to said second end of said lead screw to prevent rotation of said motor as said lead screw rotates.

4. A removable lead screw assembly according to claim 3, wherein one of said first attraction member and said second attraction member is a magnet and the other of said first attraction member and said second attraction member is a ferromagnetic member.

5. A removable lead screw assembly according to claim 3, wherein said bearing member is a magnetically loaded radial bearing.

6. A removable lead screw assembly according to claim 3, wherein said writing element is a print head of said image capture device.

7. A method of removably mounting a lead screw assembly of an image capture device, the method comprising the steps of:

providing a first attraction member on a first end of a lead screw, said lead screw defining a linear direction of movement for a writing assembly of said image capture device;

providing a bearing member on a second end of said lead screw;

attaching said lead screw to a frame member of said image capture device, such that said first attraction member cooperates with a second attraction member on said frame and said bearing member cooperates with a receiving member on said frame to removably hold said lead screw to said frame at said first and second ends;

mounting a drive motor on said second end of said lead screw, said drive motor rotating said lead screw as said lead screw is removably held at said first and second ends to impart a linear motion to said writing assembly along said linear direction of movement; and mounting a rotational stop on said second end of said lead screw to prevent rotation of at least said drive motor as said lead screw rotates.

8. A method according to claim 7, wherein said first attraction member is one of a magnetic member or a ferromagnetic member, and said second attraction member is the other of said magnetic member or said ferromagnetic member.

9. A method according to claim 7, wherein said bearing member is a magnetically loaded radial bearing and said receiving member defines a slot into which said radial bearing is inserted.

10. A method according to claim 7, comprising the further steps of:

removing said lead screw from the frame member by pulling up on said first end of said lead screw so as to space the first and second attraction members from each other and moving the second end of said lead screw so as to withdraw the bearing member from said receiving member; and replacing said removed lead screw with a further lead screw.

* * * * *